US005848927A

United States Patent [19]

Frederiksen

[11] Patent Number: 5,848,927

[45] Date of Patent: Dec. 15, 1998

[54] STACKABLE BLOCK SYSTEM

[75] Inventor: Jesper Bo Frederiksen, Nykøbing Falster, Denmark

[73] Assignee: Interlego AG, Baar, Switzerland

[21] Appl. No.: 809,517

[22] PCT Filed: Sep. 28, 1995

[86] PCT No.: PCT/DK95/00389

§ 371 Date: Jun. 9, 1997

§ 102(e) Date: Jun. 9, 1997

[87] PCT Pub. No.: WO96/09870

PCT Pub. Date: Apr. 4, 1996

[30] Foreign Application Priority Data

Sep. 29, 1994 [DK] Denmark ..... 1121/94

[51] Int. Cl.[6] ..... A63H 33/08

[52] U.S. Cl. ..... 446/128; 446/85; 446/124; 52/592.6

[58] Field of Search ..... 446/128, 85, 105, 446/106, 107, 108, 117, 118, 120, 121, 122, 124, 125, 126; 52/603, 604, 612, 561, 592.6

[56] References Cited

U.S. PATENT DOCUMENTS

| | | | |
|---|---|---|---|
| 3,597,875 | 8/1971 | Christiansen | 446/128 |
| 4,919,635 | 4/1990 | Bertrand | 446/128 |
| 5,238,231 | 8/1993 | Huang | 446/128 |

FOREIGN PATENT DOCUMENTS

| | | | |
|---|---|---|---|
| 96094 | 3/1960 | Norway | 446/128 |
| 558194 | 1/1975 | Switzerland . | |
| 2118447 | 11/1983 | United Kingdom | 446/128 |
| 9322018 | 11/1993 | WIPO . | |
| 9404240 | 3/1994 | WIPO . | |

*Primary Examiner*—Max Hindenburg
*Assistant Examiner*—Charles Marmor, II
*Attorney, Agent, or Firm*—Kane,Dalsimer,Sullivan,Kurucz,Levy,Eisele and Richard, LLP

[57] ABSTRACT

A stacking block system having stacking blocks which have a body part which is provided with coupling knobs with a mutual uniform modular distance on its upper surface and is downwardly provided with coupling means which are complementary with respect to the coupling knobs on the upper side and are adapted to be coupled with the coupling knobs. According to the invention, the blocks are additionally provided with one or more spacers downwardly, which are designed such that when two stacking blocks are stacked on top of each other, the body parts of the stacking blocks will be spaced from each other along their entire periphery. This provides a gripping edge or a gap between two blocks stacked so that it is particularly easy to grip the blocks when a stack of such blocks is to be separated.

8 Claims, 4 Drawing Sheets

STACKABLE BLOCK SYSTEM

BACKGROUND OF THE INVENTION

1. Field of the Invention

The present invention concerns a stacking block system comprising stacking blocks each having a body part which is provided with one coupling knob or a plurality of coupling knobs with a mutual firm modular distance on its upper side and is downwardly provided with complementary coupling means adapted to be coupled with coupling knobs of another of said blocks.

2. Description of the Prior Art

Such stacking block systems or building block systems are available in numerous different embodiments, which are frequently specially designed for the building of structures of different types. Since these known systems are frequently designed such that there are no gaps between two blocks which are stacked on top of each other, these blocks can be separated only by pulling or twisting off the blocks from above.

If a wall or a column of a certain dimension is built, it is extremely difficult to separate the blocks e.g. at the center of the wall or the column.

The object of the present invention is to provide a stacking block system which, to a higher degree than the known ones, provides blocks which are simple to separate, in particular for small children, i.e. children under 2–3 years of age.

SUMMARY OF THE INVENTION

This is achieved with a stacking block system of the type mentioned in the opening paragraph in that the blocks downwardly have one or more spacers which are shaped such that when two stacking blocks are stacked on top of each other, the body parts of the stacking blocks will be spaced from each other along their entire periphery. This provides a recess or a gripping edge which ensures that e.g. the fingers of a child can easily catch hold of the lower edge of a given stacking block, also even if the stacking block concerned should be present in the center of a constructed wall or column or the like.

It is stated in claim 2 that the distance between the body parts is expediently greater than 3 mm, so that the recess established between the body parts of two stacking blocks stacked on top of each other serves extremely well as a gripping edge for the hand of a child of the above-mentioned age.

As stated in claims 3 and 4, respectively, the coupling connection may be established either in that the height of the coupling knobs above the body parts of the stacking blocks is greater than the distance between the body parts of the stacking blocks when stacked, or in that the height of the coupling knobs above the body parts of the stacking blocks is smaller than the distance between the body parts of the stacking blocks when stacked, and that the complementary coupling means extend somewhat below the body parts of the stacking blocks.

The spacers establishing the distance between two stacking blocks upon stacking, may be provided as elements having just this function, but in a preferred embodiment according to claim 5, the spacers form part of the complementary coupling means.

The coupling knobs and the complementary coupling means may be provided in many ways. However, claims 6 and 7 define preferred embodiments of these.

The large coupling knobs may expediently have a mutual modular distance which is three times greater than the modular distance between the small coupling knobs, as stated in claim 8. This ensures a high degree of compatibility between the coupling knobs, thereby providing increased play value since the stacking blocks may be stacked arbitrarily on top of each other irrespective of which coupling knobs are present on the individual stacking block.

Claim 9 defines an expedient embodiment of the invention, in which the stacking blocks have a substantially box-shaped body part with outer transverse dimensions corresponding to an integer multiple of the modular distance between the large coupling knobs, and wherein the small coupling knobs have a height above the body part of the stacking block which is smaller than the distance between the body parts of the stacking blocks when stacked. This ensures additionally increased compatibility, since the box-shaped body part on the stacking block, even though it partly covers a row of the small coupling knobs, does not prevent the stacking block from being placed on a building plate having a large number of small coupling knobs in a square pattern.

Claim 10 defines a particularly expedient embodiment, where the play value of the stacking block system is particularly great, since a frictional coupling is provided between the small coupling knobs and the cylindrical coupling tubes, while no friction occurs when the cylindrical coupling tubes and the large coupling knobs are coupled. This provides a varied degree of difficulty for the stacking of the blocks, it being extremely simple to stack blocks on the large coupling knobs without friction, but somewhat more difficult to stack blocks on the small coupling knobs with friction. The visual difference between the large and the small coupling knobs additionally gives the child, who plays with the stacking blocks, the possibility of selecting the degree of difficulty in a simple manner.

Embodiments of the invention will be described more fully below with reference to the drawing, in which:

DESCRIPTION OF THE PREFERRED

Figure 1:
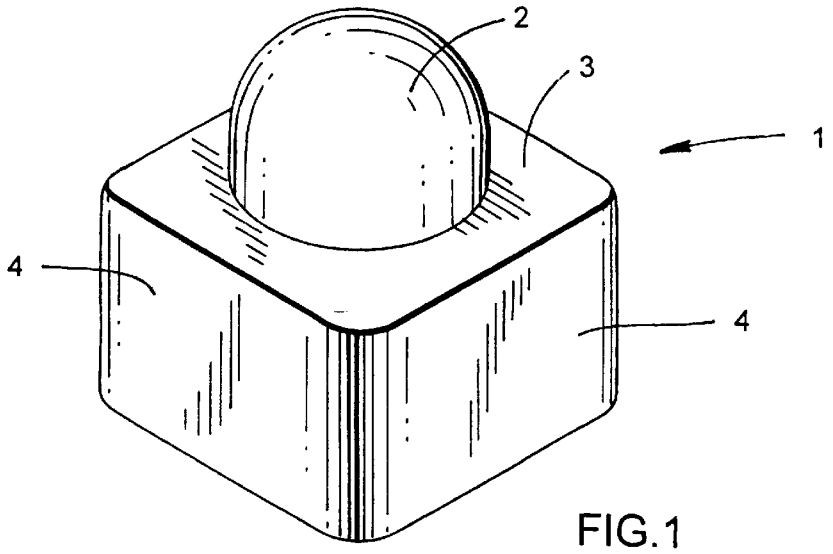
FIG. 1 is a perspective view, obliquely from above, of an embodiment of a stacking block according to the invention.

FIG. 1 thus shows a stacking block 1 having a single knob 2. The knob 2 is provided centrally on the box-shaped body part 3. The box-shaped body part 3 is defined by four side faces 4. The knob 2 is downwardly shaped as a circular symmetrical cylinder, optionally with a slight cone which narrows the knob 2 upwardly. The top face of the knob 2 is here shaped as part of a ball shell, thereby imparting an appearance with very round shapes to the knob. The very round shapes on the knob 2 hereby provide a good gripping face for a child's hand, while there are no sharp edges which may be unpleasant to step on, fall on or the like.

Figure 2:
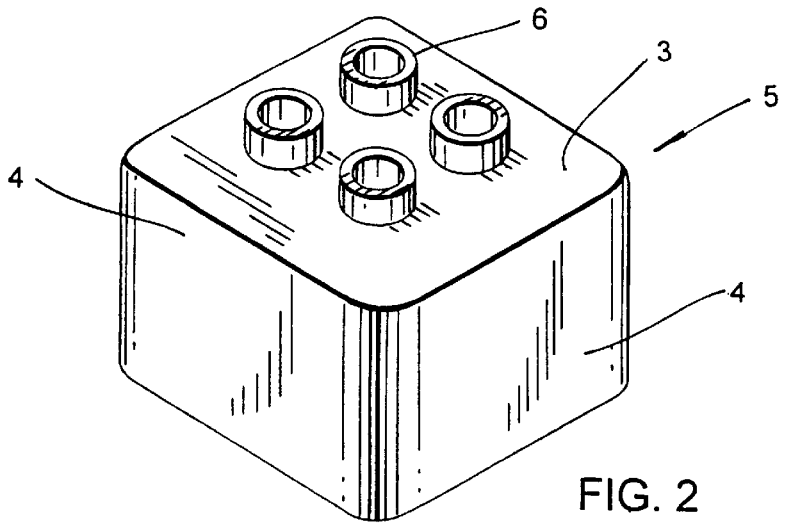
FIG. 2 is a perspective view, obliquely from above, of another embodiment of a stacking block according to the invention.

FIG. 2 shows another stacking block 5 according to the invention, which has a box-shaped body part 3 like the stacking block 1 shown in FIG. 1. The stacking block 5 shown in FIG. 2 differs from the stacking block 1 of FIG. 1 only in that it is provided with four small coupling knobs 6.

Figure 3:
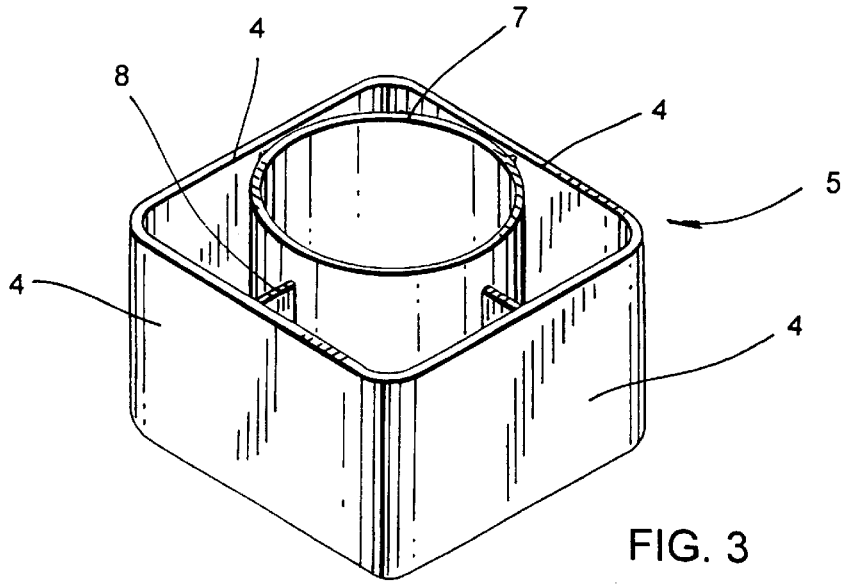
FIG. 3 is a perspective view, obliquely from below, of the stacking block of FIG. 1 or FIG. 2.

FIG. 3 shows the stacking block 5 of FIG. 2 from below. It will be seen that the stacking block 5 is hollow interiorly and is provided with a coupling tube 7, which is stiffened with respect to the side walls 4 by means of ribs 8 provided for the purpose. This embodiment is particularly simple to produce in an injection moulding process.

The coupling tube 7, which is seen in FIG. 3, has a diameter enabling the coupling tube 7 to be lowered over the coupling knob 2 on the stacking block 1 in FIG. 1 or over the four small coupling knobs 6 on the stacking block 5 of FIG. 2. This enables stacking of several such blocks.

As will be seen in FIG. 3, the coupling tube 7 extends beyond the box-shaped body part which is surrounded by the side walls 4. This means that when the blocks are stacked on each other, the box-shaped body parts 3 on the stacking blocks will be spaced from each other.

Figure 4:
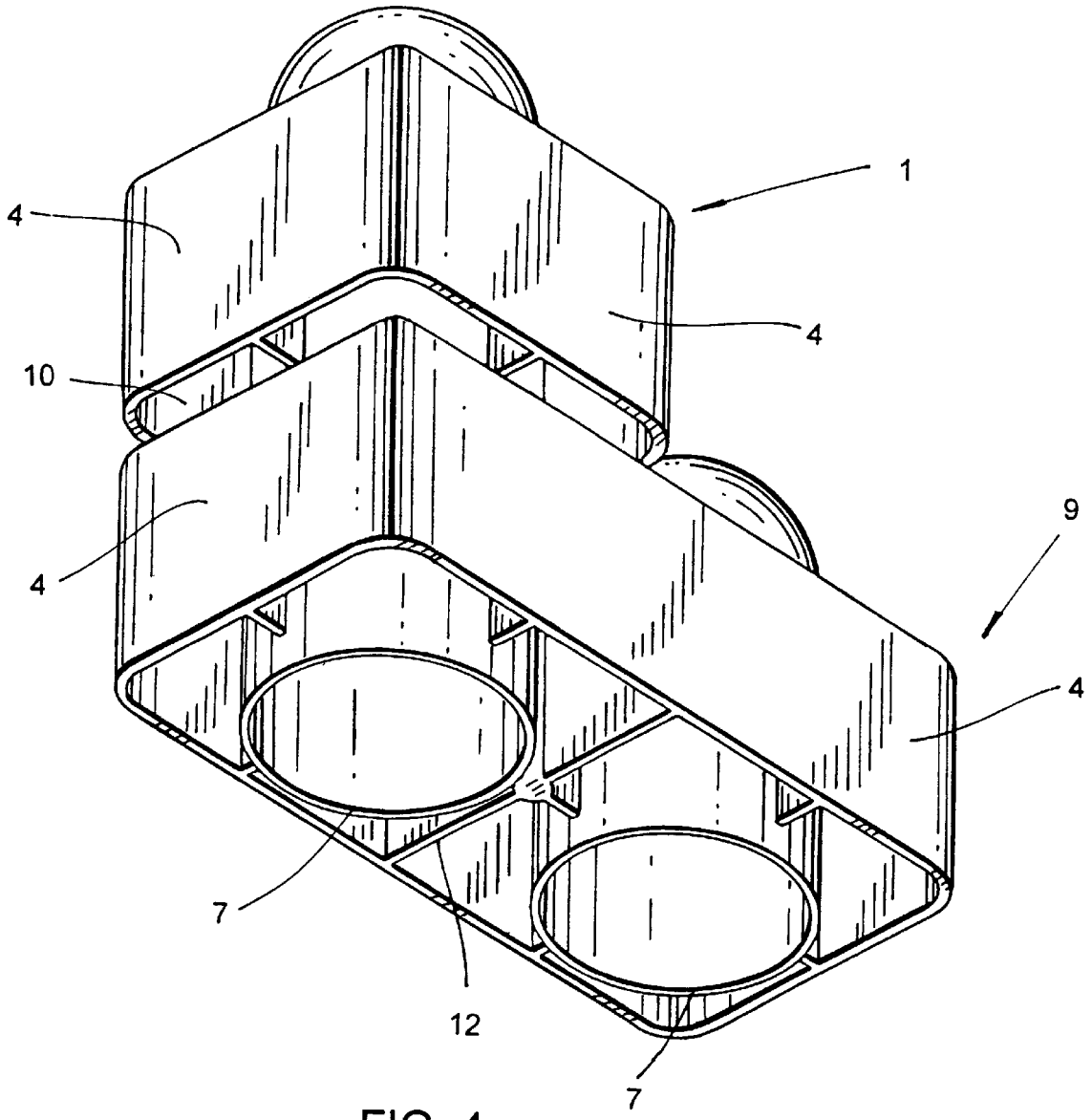
FIG. 4 is a perspective view, obliquely from below, of two stacking blocks according to the invention stacked on each other.

This is illustrated in FIG. 4, which shows a stacking block 9 twice as big as the stacking blocks in FIGS. 1–3, and a stacking block 1 of the type shown in FIG. 1 being placed on the stacking block 9. As will be seen, this results in a gap 10 between the stacking block 9 and the stacking block 1, having a width corresponding to the distance with which the coupling tube 7 of FIG. 3 protrudes from the body part on the stacking block, which body part is defined by the side faces 4. Hereby a gripping edge is provided by which it is extremely easy to grip the stacking block 1 at the gap 10, so that the stacking block 1 may be lifted from the lowermost stacking block 9, as shown in FIG. 4.

Figure 5:
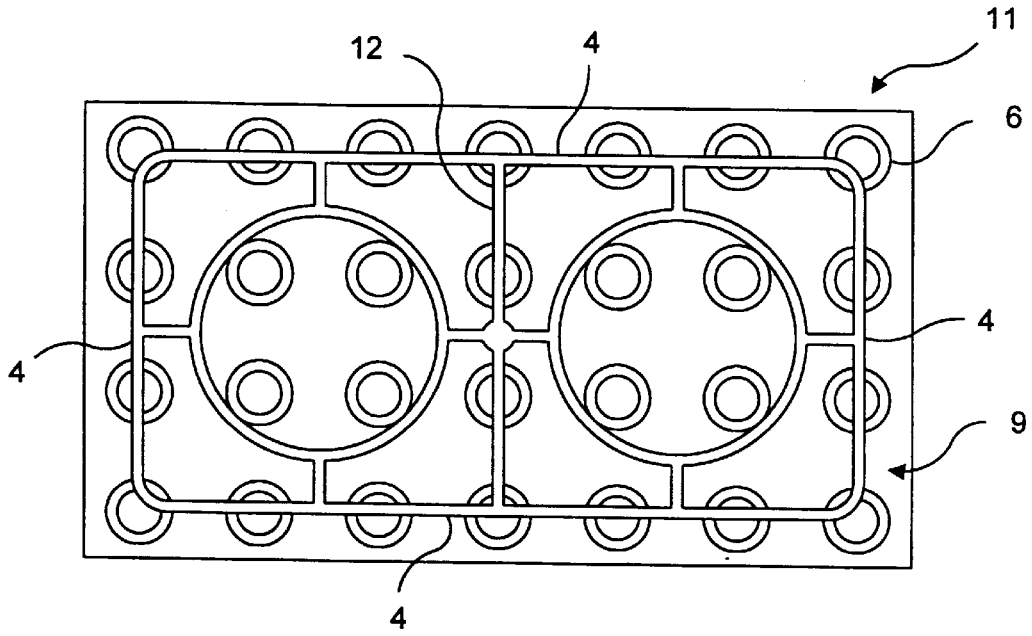
FIG. 5 is a sectional top view of a stacking block of FIG. 4, placed on a building plate.
Figure 6:
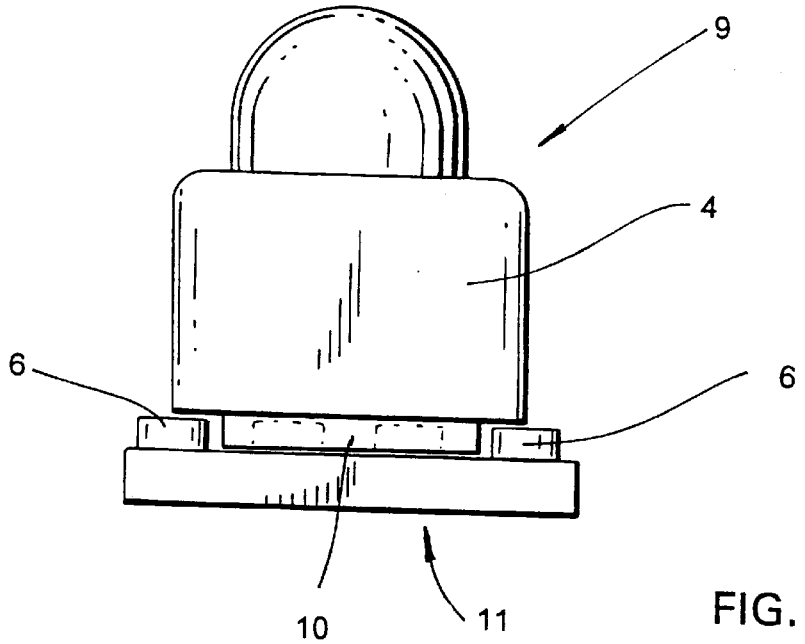
FIG. 6 is a lateral view of the building plate and the stacking block of FIG. 5.

FIGS. 5 and 6 illustrate further advantages of the present invention, showing how it is possible to combine coupling systems with different modular distances. Thus, FIG. 5 shows a building plate 11 which is provided with coupling knobs 6, here shown with four rows each having seven coupling knobs 6. These coupling knobs 6 correspond to the coupling knobs 6 on the stacking block 5 shown in FIG. 2.

The shape of a cross-section of the stacking block 9 shown in FIG. 4 is drawn in thick line, and it will be seen how the side walls 4 and the inner flange 12 intersect the coupling knobs 6 on the building plate 11. However, since a gap 10 is provided between the coupling plate 11 and the stacking block 9, it is nevertheless possible to interconnect these, because the gap 10 is wider than the height of the coupling knobs 6 on the building plate 11.

Figure 7:
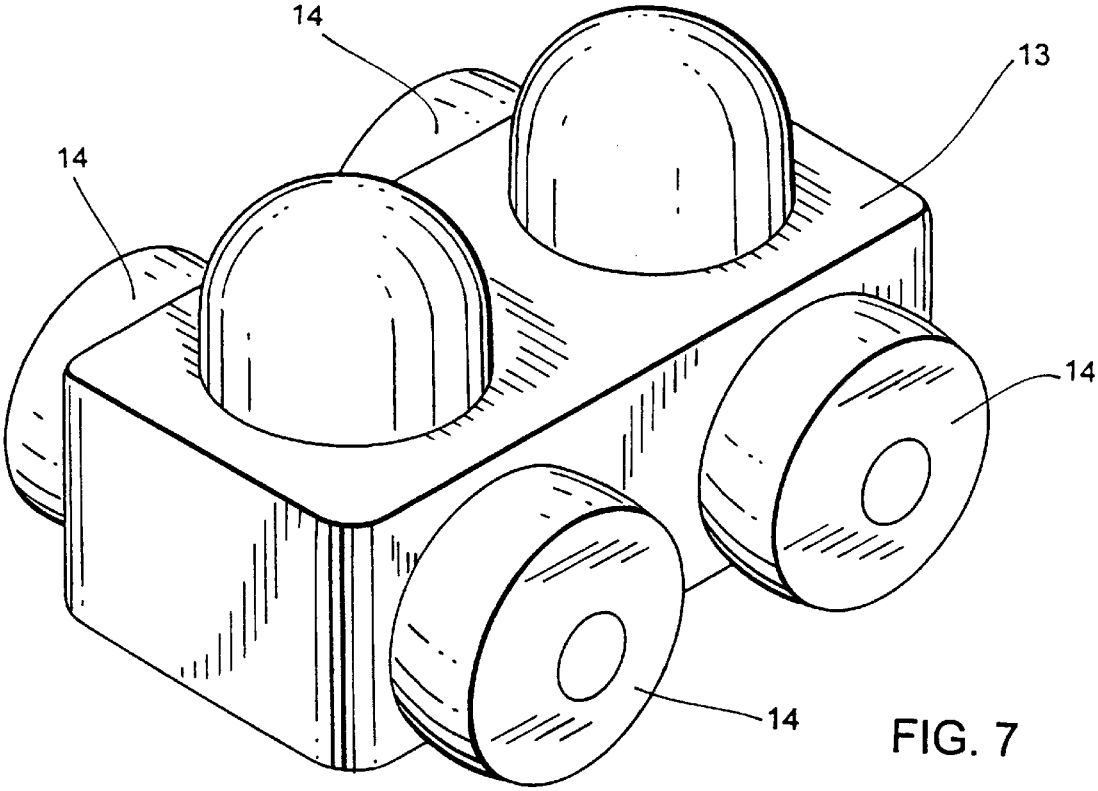
FIG. 7 is a perspective view, obliquely from above, of an alternative embodiment of a stacking block according to the invention with wheels.
Figure 8:
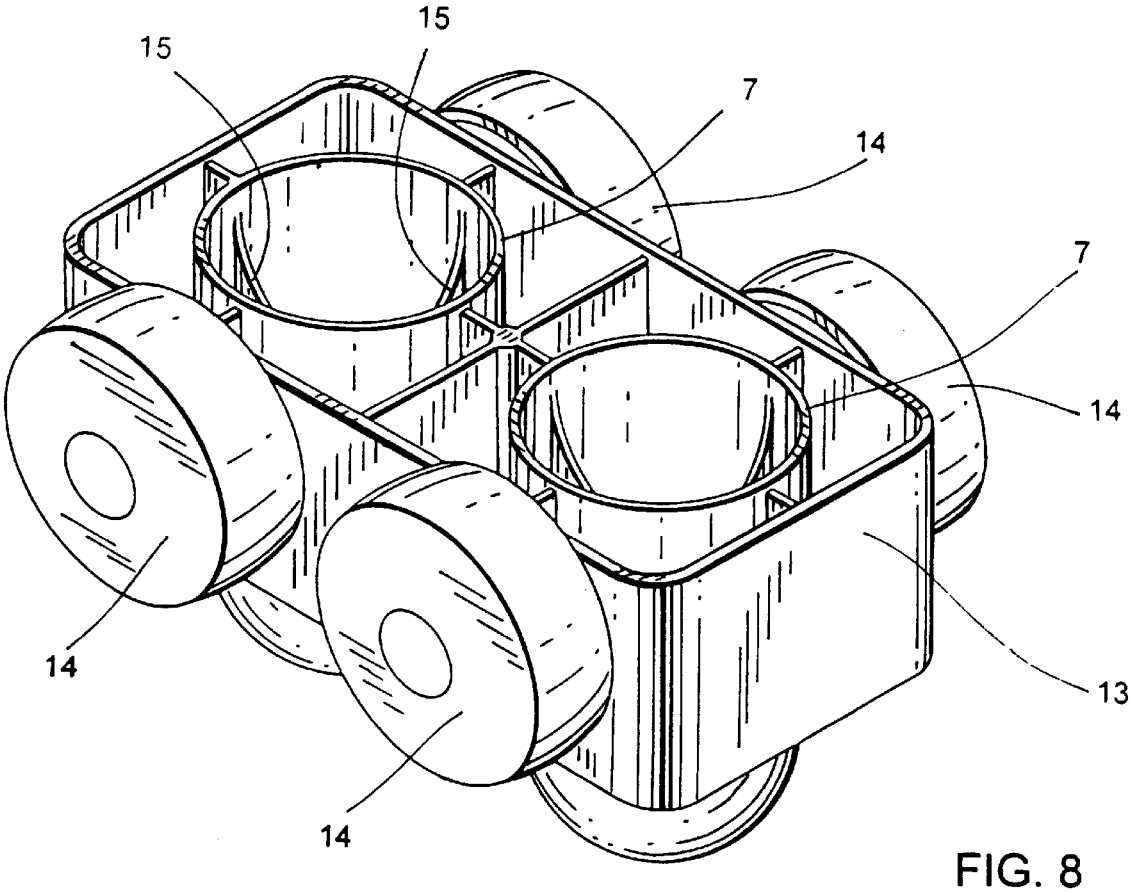
FIG. 8 is an oblique bottom view of the stacking block of FIG. 7.

According to the invention, the gap between the stacking blocks may be established in other ways than by extending the coupling tube 7 below the body parts of the stacking blocks. Thus, FIGS. 7 and 8 show an alternative embodiment of a stacking block comprising a base member 13 which substantially corresponds to the stacking block 9 of FIG. 4. As will be seen in FIGS. 7 and 8, the base member 13 is provided with four wheels 14. If the coupling tubes 7, which are shown in FIG. 8, are extended as shown in the previous embodiments, this would require extremely large wheels. Therefore, the interior of the coupling tubes 7 is formed with flanges 15 which, upon stacking on another block having large coupling knobs, e.g. the one shown in FIG. 1, engage the surface of the coupling knobs 2 and ensurs the provision of a gap between these.

Thus, a gap between two stacking blocks according to the invention may be provided in many different ways, and it is obvious to a skilled person to teach a very large number of such possible variations. In addition, the shown embodiments of the invention may be varied to a great extent, both as regards the shape of the stacking blocks, the number of knobs and the like, and as regards selection of material.

I claim:

1. A stacking block system comprising stacking blocks (1,5,9) each having a body part (4) which, on its upper side (3), is provided with a number of coupling knobs (2,6) having a mutual uniform modular separation distance, and is downwardly provided with complementary coupling means (7) adapted to be coupled with coupling knobs of another of said blocks, characterized in that the blocks have one or more spacers extending below the body part of the blocks, the spacers being designed such that when two stacking blocks are stacked on top of each other the body parts (4) of the stacking blocks will be spaced from one another along their entire periphery, and characterized in that the height of the coupling knobs (2) above the body parts (4) is greater than the distance between the body parts (4) of the stacking blocks when the stacking blocks (1, 9) are stacked.

2. A stacking block system according to claim 1, characterized in that the distance between the body parts (4) is greater than 3 mm.

3. A stacking block system according to claim 1 characterized in that the spacers are provided as part of the complementary coupling means (7).

4. A stacking block system according to claim 1, characterized in that the complementary coupling means (7) are formed by cylindrical coupling tubes and that the coupling knobs (2, 6) comprise large coupling knobs (2) having an outer shape which fits in the cylindrical coupling tubes (7) when the blocks (1, 9) are stacked.

5. A stacking block system according to claim 4, characterized in that the system further comprises blocks provided with small coupling knobs (6) which are arranged in a square pattern having a mutual modular separation distance and a diameter such that precisely four of the small coupling knobs (6) are surrounded by a cylindrical coupling tube (7) when the blocks (1, 5, 9) are stacked.

6. A stacking block system according to claim 5, characterized in that the modular separation distance between the large coupling knobs (2) is three times the modular separation distance between the small coupling knobs (6).

7. A stacking block system according to claim 6, characterized in that it comprises stacking blocks having a substantially box-shaped body part (4) with outer transverse dimensions corresponding to an integer multiple of the modular distance between the large coupling knobs (2), and that the small coupling knobs (6) have a height above the body part (4) of the stacking block which is smaller than the distance between the body parts (4) of the stacking blocks upon stacking.

8. A stacking block system according to claim 7, characterized in that the coupling knobs and the cylindrical coupling tubes (7) are dimensioned so as to provide a frictional coupling between the small coupling (6) knobs, the large coupling knobs (2) and the cylindrical coupling tubes (7) when the blocks are stacked.

* * * * *